United States Patent [19]

Tsai et al.

[11] Patent Number: 4,570,755

[45] Date of Patent: Feb. 18, 1986

[54] DIGITAL LANDING COMPUTER FOR ELEVATOR

[75] Inventors: George C. Tsai, Louisville; Svend J. Bentsen, Crestwood, both of Ky.

[73] Assignee: Armor Electric Company, Inc., Louisville, Ky.

[21] Appl. No.: 508,284

[22] Filed: Jun. 27, 1983

[51] Int. Cl.[4] ..... B66B 1/30

[52] U.S. Cl. ..... 187/29 R; 318/603; 318/626; 318/467

[58] Field of Search ..... 187/29, 29 R; 318/602, 318/603, 561, 626, 467

[56] References Cited

U.S. PATENT DOCUMENTS

| | | | |
|---|---|---|---|
| 3,207,265 | 9/1965 | Lund et al. | 187/29 |
| 3,589,474 | 6/1971 | Wavre | 187/29 R |
| 3,743,055 | 7/1973 | Hoelscher | 187/29 R |
| 3,749,203 | 7/1973 | Hoelscher | 187/29 R |
| 3,777,855 | 12/1973 | Boyldew et al. | 187/29 R |
| 3,779,346 | 12/1973 | Winkler | 187/29 R |
| 3,948,357 | 4/1976 | Maynard | 187/29 R |
| 3,983,961 | 10/1976 | Aron | 187/29 R |
| 4,102,436 | 7/1978 | Kernick et al. | 187/29 R |
| 4,155,426 | 5/1979 | Booker | 187/29 R |
| 4,278,150 | 7/1981 | Wehrli et al. | 187/29 R |
| 4,318,456 | 3/1982 | Lowry | 187/29 R |
| 4,351,416 | 9/1982 | Terazono et al. | 187/29 R |
| 4,356,896 | 11/1982 | Tamura et al. | 187/29 R |
| 4,446,946 | 5/1984 | Kajiyama et al. | 187/29 R |
| 4,456,096 | 6/1984 | Kajiyama | 187/29 R |

*Primary Examiner*—William M. Shoop, Jr.
*Assistant Examiner*—Shik Luen Paul IP
*Attorney, Agent, or Firm*—Polster, Polster and Lucchesi

[57] ABSTRACT

An electronic landing device for controlling the movement of an elevator car during the final several inches of travel approaching a floor. The device provides a smooth transition from run (deceleration) mode to landing mode within a wide range of speeds at the transfer point. A digital computation is performed on a speed signal generated at the transfer point, to provide optimum time-to-landing and decelaration profile during the landing mode.

22 Claims, 3 Drawing Figures

DIGITAL LANDING COMPUTER FOR ELEVATOR

BACKGROUND OF THE INVENTION

This invention relates to a system for controlling the movement of a body, such as an elevator car, between a point a fixed distance from a landing and the landing itself. It will be understood that although the invention is described as applied to a landing computer for an elevator system, it may also be applied to other systems.

Numerous systems are presently known for controlling the movement of an elevator car. Typically, they include an electronic drive circuit for generating a speed pattern which controls the movement of the car in a run mode. The electronic drive circuit receives such information as elevator car position, calls registered, and distance to the next called landing, and produces a speed pattern which accelerates the car to a maximum allowable speed for the distance to be traveled, maintains that speed if sufficient distance remains to the next selected landing, and decelerates the car toward the selected landing. Feedback control of the running speed pattern may be based on car velocity information or absolute position information relative to the desired velocity or instantaneous position. The drive circuit speed pattern is generally a variable voltage, which is applied to the drive motor of the elevator system. The elevator car may run at a maximum speed of from two hundred to five hundred feet per minute in a moderate speed elevator, and up to eighteen hundred feet per minute or more in a high speed elevator.

Regardless of the type of run mode circuitry utilized in an elevator system, a separate landing circuit is generally provided to bring the car to a level stop at the selected landing.

The separate landing circuit generally takes control of the elevator car at the leveling zone, which may extend from about ten to thirty inches from the landing. The landing circuit is required because a number of variables, such as changes in load, and a wide range of speeds at the leveling zone which, make accurate deceleration and leveling of the car at the selected landing by the main drive circuit unreliable.

The leveling zone is generally defined by a landing and leveling transducer mounted on the car and a vane mounted in the hoistway at each potential landing. The leveling transducer typically includes units carried by the car and a vane mounted in the hoistway at each landing. In some systems, a set of magnetic units carried by the car are operated by a vane in the hoistway. In many systems, a carefully profiled vane is mounted in the hoistway, and a non-contacting sensor is mounted on the elevator car. The sensor may, for example, include a set of electromagnetic or optical units. The vane is shaped to cause the sensor to produce a varying signal as the sensor moves along the vane, and that signal is fed to the elevator motor to bring the elevator to an accurate stop.

The present invention provides an improved elevator landing system.

The landing system of the present invention is particularly well adapted for use in the elevator system shown in Maynard et al., U.S. Pat. No. 3,948,357, assigned to the assignee of the present application. Other typical control circuits, in which the present invention would also be usable, are shown in U.S. Pat. No. 3,777,855 to Boyldew et al., and in U.S. Pat. No. 4,155,426 to Booker, for example.

As shown in U.S. Pat. No. 3,948,357 to Maynard et al, U.S. Pat. No. 3,749,203 to Hoelscher, U.S. Pat. No. 3,983,961 to Aron, U.S. Pat. No. 3,207,265 to Lund et al., and U.S. Pat. No. 4,318,456 to Lowry, prior art landing systems generally operate with a fixed, predetermined profile of velocity against position. The predetermined profile usually changes the car's velocity in proportion to the square root of the distance remains to the landing, so as to provide a constant deceleration. In the last fraction of an inch of the car's travel, the landing system generally utilizes a predetermined terminal crawl speed of above five feet per minute.

As the elevator car approaches a leveling zone, the elevator system's main drive circuit seeks to match the deceleration and speed of the car to the predetermined landing profile, so as to provide a smooth transition to the landing system. Because of the limitations of practical systems, this matching is not always possible, and the transition is not always smooth.

Because of the inflexibility of conventional elevator landing systems, the time required for landing the elevator car is sometimes quite slow, and on short trips the time required for the last twenty or so inches before landing may be a large proportion of the total travel time. This reduces the efficiency of the elevator system.

Because the landing system utilizes a square root function, the transition to the crawl speed is also not smooth.

SUMMARY OF THE INVENTION

One of the objects of this invention is to provide a landing system for an elevator or the like which inherently provides a smooth transition from control of deceleration by a drive circuit to control by a landing circuit.

Another object is to provide such a system which generates a landing curve of varying slope proportional to the deceleration required at a given instant, rather than a constant slope.

Another object is to provide such a system which is capable of handling a relatively wide range of speeds, for example from one hundred fifty to two hundred twenty-five feet per minute, at the transfer point.

Another object is to provide such a system which reduces the time required for landing an elevator car, and therefore increases the efficiency of an elevator system using it.

Another object is to provide such a system which is easily adjustable to accommodate different drive systems and different operational requirements, and to provide different speed/distance profiles.

Another object is to provide such a system which may easily be substituted for existing landing systems.

Another object is to provide such a system which is low in cost.

Other objects will occur to those skilled in the art in light of the following description and accompanying drawings.

In accordance with this invention, generally stated, an improved landing system is provided for an elevator system or the like, in which an object such as an elevator car is moved along a fixed path and stopped at landing points on the fixed path. Such systems include motive means for moving the object, pattern generating means for generating a running speed signal to control the operation of the motive means in a run mode of the transportation system, including means for decelerating the object as it approaches a landing point, and transfer means for establishing a transfer position of the object a fixed distance from the landing point. The improved landing system controls movement of the object in a landing mode between the transfer position and the landing point, by storing the instantaneous value of the running speed signal at the transfer position and operating on that value to generate a landing speed signal.

The landing system is preferably a digital computer which operates on the instaneous value of the speed signal, or transfer signal, digitally. The digital calculations produce a speed curve which smoothly and incrementally changes the rate of deceleration of the car from the transfer speed value to a crawl speed for the last fraction of an inch before the landing. In the preferred embodiment, if the velocity of the car at the transfer point twenty-four inches from the landing is two hundred feet per minute, the landing computer is capable of providing a smooth and accurate landing in about 1.2 seconds.

In the preferred embodiment, the running speed signal and the landing speed signal are analog values, and the landing signal generating means comprise a digital-to-analog converter. The distance to landing is constantly monitored from the transfer point to the landing, and this value is also utilized in calculating the optimum speed/time curve. Position indicating means operatively connected to the car generate a train of pulses, each pulse representing movement of the car through a particular distance along the path. The computer comprises a down counter operatively connected to the digital-to-analog converter for decrementing the digital input to the digital-to-analog converter, and means are operatively connected between the position indicating means and the down counter for sequentially reducing the number of pulses required to decrement the digital input to the digital-to-analog converter. Preferably, these means are a divide-by-N circuit, and a control input of the divide-by-N means is operatively connected to the output of the down counter for reducing the value of N in response to an output signal from the down counter. This arrangement keeps the rate of deceleration from decreasing too rapidly at first, and produces a deceleration curve which is continuously lessened as the car approaches the floor, to smoothly slide it into the landing level. It thereby decreases the time to landing without creating any jerk or causing discomfort to passengers in the car.

In the preferred embodiment, if the elevator car's speed at the transfer point is outside its the designed capture window, the landing circuit of the present invention will nonetheless try to land the car, producing a deceleration curve which is adjusted accordingly. In this case, the only effect on the system will be a noticeable rate change at the transfer point to the landing mode, and a faster or slower landing of the car.

In the preferred embodiment, the landing computer also comprises a curve switch and comparator, connected to the divide-by-N means, which sets a minimum value of N, thereby fixing the total number of the pulses required to decrement the digital input to the digital-to-analog converter to a pre-selected number at a nearly constrant deceleration and, therafter, exponentially to the final speed. The curve switch is preferably a bank of manually settable switches (thumb switches), which permit a setting of from one to fifteen. The setting of the curve switch is made in accordance with the conditions of a particular elevator installation.

In the preferred embodiment, the landing computer also comprises a final speed switch and comparator for setting a minimum value of the digital input to the digital-to-analog converter. This value, which is a small fraction of the transfer signal's value, is used as a final crawl speed into the landing. The final speed switch, like the curve switch, is preferably a set of thumb switches, which permit a setting from zero to fifteen. If a positive number is chosen, when the digital input to the digital-to-analog converter has reached a value of that number (so that its output is the transfer signal times that number divided by 256), the speed of the car is maintained at that crawl speed until the leveling transducer signals that the precise landing has been reached. This distance is generally a fraction of an inch.

In addition to the final speed switch and comparator, the preferred embodiment also includes separate means for generating a crawl speed signal which is applied to the motive means independent of the landing speed signal during the last fraction of an inch of travel of the object before the landing.

The preferred embodiment also utilizes a particularly simple leveling tranducer for indicating when the elevator car has reached a leveling zone and for indicating when it has reached the landing. The tranducer may include a twenty-four inch long rectangular vane mounted in the hoistway at each potential landing, and optical couples carried on the car. The upper and lower pairs of optical couples are spaced apart twenty-four inches. They provide a leveling zone signal when the first set of couples is broken by the vane and a stop signal when both couples are again completed as they straddle the vane. The required door zoning and other uses, are accomplished by additional pairs of optical couples located, between the upper and lower pairs of couples.

DESCRIPTION OF THE PREFERRED EMBODIMENT

Figure 1:
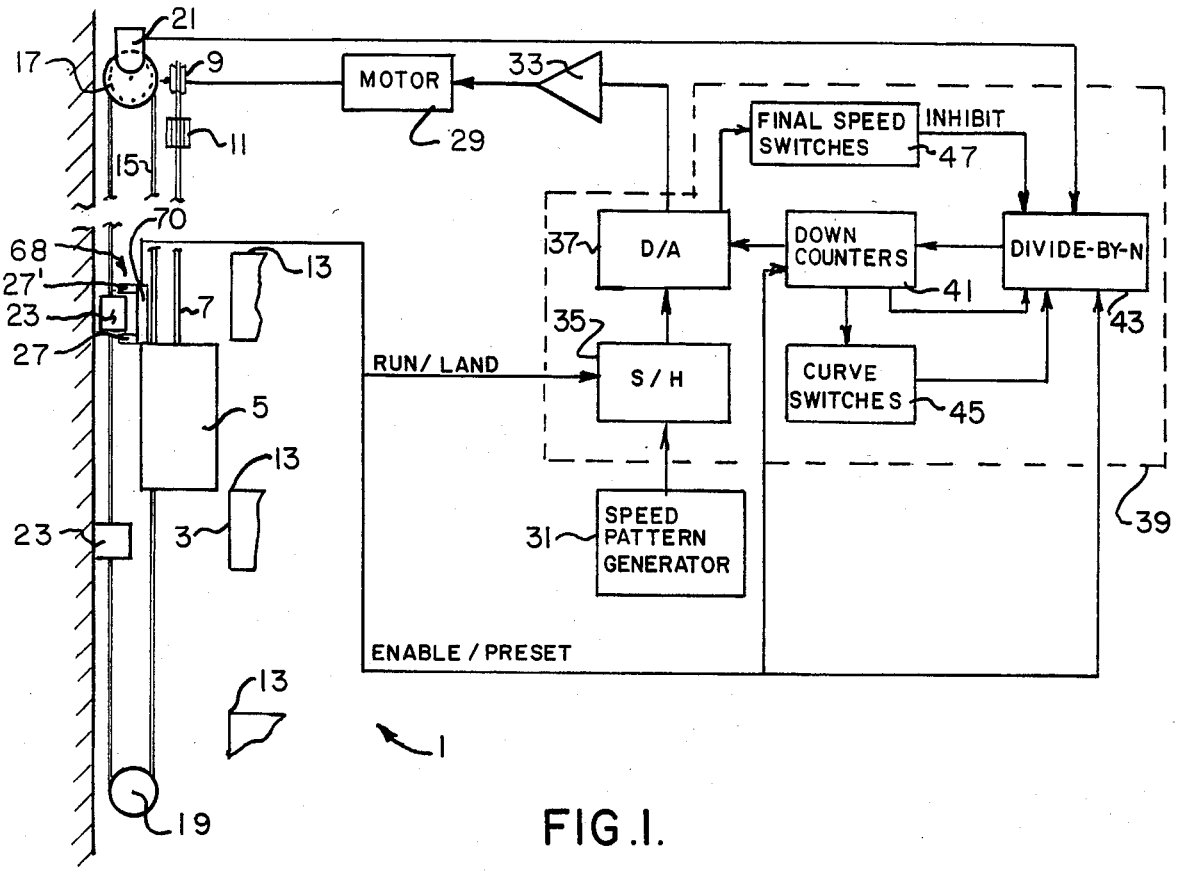
FIG. 1 is a diagrammatic view of an elevator system incorporating a preferred embodiment of landing computer of the present invention.

Referring now to the drawings, and in particular to FIG. 1, for a presently preferred embodiment of the invention, reference numeral 1 indicates an elevator system incorporating the landing system of the present invention.

The elevator system 1 includes a hoistway 3 in which an elevator car 5 is mounted for movement with respect to the hoistway and the building structure in which it is located. The elevator car 5 is suspended by a cable 7 which is reeved over a traction sheave 9. The other end of the cable 7 carries counterweights 11. The elevator car 5 is movable between landings, three of which are illustratively indicated at 13, in the hoistway. A governor cable 15 is also attached to the car 5. It is reeved over a governor sheave 17 located at the top of the hoistway 3 and over a pulley 19 at the bottom of the hoistway 3. The governor sheave 17 is provided with a standard shaft-mounted digital encoder 21, which produces a train of pulses, representative of the number of revolutions of the governor sheave 17, as the governor sheave 17 rotates. In the preferred embodiment, the digital encoder 21 produces one thousand three hundred-ten (1310) pulses per foot of travel of the car 5.

Mounted securely in the hoistway 3, a fixed distance above each landing 13, are vanes 23, which form a part of a landing and leveling transducer 68. The vanes 23 are simple rectangular pieces of sheet metal, having a height of precisely twenty-four inches. The vanes 23 are mounted by conventional means in the hoistway 3.

Mounted on the elevator car 5 is a cooperating part 70 of the landing and leveling transducer 68. The leveling transducer 68 includes two pairs of optical couples 27 and 27', spaced vertically apart twenty-four inches. Each optical couple consists of a light-emitting diode mounted on one side of the part 70 of the transducer 68, and a matching light-sensitive transistor spaced from the light-emitting diode in such a way that the vanes 23 will come between the halves of each pair as the elevator moves past the vane 23. The light-emitting diode and light-sensitive transistor preferably respond to a narrow band of the infra-red spectrum. As one leveling transducer couple 27 or 27' first intercepts the vane 23 defining the target leveling zone, the transducer 68 produces a landing intercept signal which transfers the operation of the elevator system from a run mode to a landing mode of operation, as described hereinafter. When both transducer couples 27 and 27' are next recoupled, the transducer 68 on the elevator car 5 is precisely straddling the vane 23, with one couple 27 below the vane 23 and the other couple 27' above the vane 23, and the transducer 68 produces a landing signal indicating that the car 5 has landed.

The traction sheave 9 is connected directly to a large direct current motor 29, for rotation in either direction by the motor.

All of the elements thus far described, except the particular configuration of the transducer components, are standard and well-known in the art, and their exact nature is not critical to the present invention.

The motor 29 is controlled by a control system shown in the right-hand portion of FIG. 1. The control system includes a speed pattern generator 31 which generates a variable voltage and applies the voltage through an amplifier 33 to the armature of the motor 29 in order to control the movement of the motor 29 and elevator car 5. The speed pattern generator 31 receives signals from a floor selector logic circuit, not shown, and responds by applying signals to the motor 29 to accelerate the car 5 from its present landing 13, bring the car to a maximum running speed if the distance to travel permits reaching that speed, and beginning the deceleration of the car when it reaches the slow down point for the selected landing 13. All of these actions constitute a part of a regular run program by the speed pattern generator 31.

Connected between the speed pattern generator 31 and the amplifier 33 are a sample-and-hold circuit 35 and a digital-to-analog converter 37, which forms parts of the landing computer 39 of the present invention.

The sample-and-hold circuit 35 performs merely a sampling function during the run mode of the system, and holds the instantaneous value of the speed pattern (voltage level) generated by the speed pattern generator 31, only in response to the landing intercept signal from the landing transducer 68. This instantaneous value becomes the transfer signal which is used as a reference by the landing computer 39 in the leveling mode of the system.

The digital-to-analog converter 37 receives an reference signal, whether the signal is the speed pattern or the transfer signal, intrinsically breaks it into two hundred fifty-six steps, and produces an output which is equal to a number of steps set by a digital control signal. Thus, if the input to the digital-to-analog converter 37 is a voltage representing a speed of one hundred ninety-two feet per minute, each step has a value of 0.75 feet per minute; if the digital control signal is set to its maximum of two hundred fifty-five, the output signal is 191.25 feet per minute. While the system is in its run mode, the digital control signal is maintained at its maximum value.

The landing computer 39 also includes computation means, for controlling the digital control signal to the digital-to-analog converter 37, comprising a set of down counters 41 and a divide-by-N circuit 43 attached between the digital encoder 21 and the down counters 41.

The divide-by-N circuit 43 is enabled and the initial value of N is preset to sixteen prior to the initiation of the landing intercept signal from the landing transducer 68. The pulses generated by the digital encoder 21 provide the input to the divide-by-N circuit 43. The output of the divide-by-N circuit 43 is applied to the down counters 41.

The down counters 41 comprise two series-cascaded four-bit down counters whose output controls the decrement of the digital-to-analog converter 37. Each output of the down counters 41 reduces the output of the digital-to-analog converter 37 by one step (1/256 of the analog input). As indicated above, the down counters 41 are also initially preset prior to the landing intercept signal from the landing transducer 68 to the maximum value ("11111111"). When the down counters have produced sixteen outputs, corresponding to two hundred fifty-six encoder pulses, a feed-back signal is applied to the divide-by-N circuit 43, thereby reducing the value of N by one, to fifteen. When the down counters have again produced sixteen outputs, corresponding to two hundred forty encoder pulses, a feed-back signal is again applied to the divide-by-N circuit 43, thereby reducing the value of N by one, to fourteen. This process continues until terminated by a curve switch, as hereinafter described.

It will be seen that the deceleration rate is far less influenced by the first encoder pulses (i.e., the divide by N rate initially changes very little with distance) than by the last encoder pulses (where the divide by N. rate change per distance is great). In fact, if the sequence were allowed to continue to the end of the landing mode, the penultimate encoder pulse would reduce the speed by 1/256, which would amount to a reduction in the speed to half its previous value. It will also be seen, however, that the initial velocity of the elevator car 5 at the transfer point is high, and that the frequency of the pulses is therefore also high, and that as the speed of the car becomes less, the frequency of the pulses becomes correspondingly less.

The landing computer 39 also includes curve comparator and switches 45 and final speed comparator and switches 47.

The curve comparator and switches 45 control the minimum permissible value of N in the divide-by-N circuit 43. The curve comparator and switches 45 include manually settable thumb wheel switches and a comparator circuit which compares the value of N with the value set by the switches. When the value of N reaches that value, the curve comparator circuit disables the feed back from the down counters 41 to the divide-by-N circuit 43, and prevents any further change in the value of N. The curve switches may be set at a value from "1111" (decimal 15) to a value of "0001" (decimal 1). Although a setting of "0000" is physically possible, it is not allowed, because it would allow the divide-by-N circuit 43 to attempt an impossible division by zero. It will be seen that the value set by the curve switches controls the number of encoder pulses required to count down to stop, and therefore determines the landing distance or at least the distance until crawl speed is initiated, as hereinafter described. It will also be seen that the value set by the curve switches simultaneously controls the shape of the deceleration curve after the value set has been reached. In most applications, a curve switch setting of about six to twelve is preferred.

The final speed comparator and switches 47 control the minimum output signal of the digital-to-analog converter 37 by controlling the minimum value of the digital control signal applied to it. Like the curve comparator and switches 45, the final speed comparator and switches 47 include manually settable thumb wheel switches and a comparator circuit. The final speed comparator compares the value of the digital control signal applied to the digital-to-analog converter 37 with the value set by the switches. When the values match, the final speed comparator circuit disables the divide-by-N circuit 43 and prevents any further output from the down counters 41, thereby freezing the value of the digital control signal applied to the digital-to-analog converter 37. Until the landing transducer 68 signals that the precise landing has been reached, the signal applied to the motor 29 remains constant, and the speed of the car remains at a constant crawl speed. The final speed switches may be set at a value from "1111" (decimal 15) to a value of "0000" (decimal 0). For most applications, a value of three to ten is preferred. It will be seen that by setting the switches at a non-zero value, it is possible to use the curve switches to aim the car 5 for a landing point slightly ahead of the landing 13. The floor is then approached at the fixed speed set by the final speed switches. It will also be seen that the value of the crawl speed is a function of the transfer speed, and that because there is no transfer to a separate crawl speed circuit, there is no possibility of a jerk when crawl speed is established.

Figure 2:
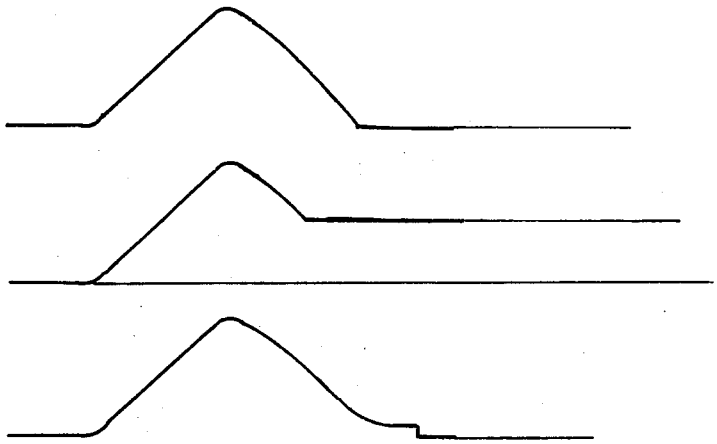
FIG. 2 is a set of curves illustrating the output of a speed pattern generator, a sample and hold circuit and a digital-to-analog converter, respectively, of the elevator system of FIG. 1.

As shown in FIG. 2, the speed signal generated by the speed pattern generator 31 (top curve) is followed by the output of the sample-and-hold circuit 35 (second curve) and by the output of the digital-to-analog converter 37 (bottom curve) until the landing transducer 68 produces a landing intercept signal indicating that the car 5 is precisely twenty-four inches from a landing. Until this point, the digital landing computer is completely transparent to the operating system. Beyond this point, the speed signal continues to decrease in accordance with its own criteria, but the sample-and-hold circuit 35 holds the instantaneous value of the speed signal as a constant output. The instaneous value of the speed signal is thereafter the transfer speed signal. As shown in the lower curve of FIG. 2, the output of the digital-to-analog converter 37 thereafter rapidly and smoothly brings the car to a constant crawl speed, at which the car travels for the final half second before the landing. This final half second, however, may typically represent more than one third of the total travel time from the twenty-four inch transfer point to the landing, and may typically represent only half an inch of travel.

Figure 3:
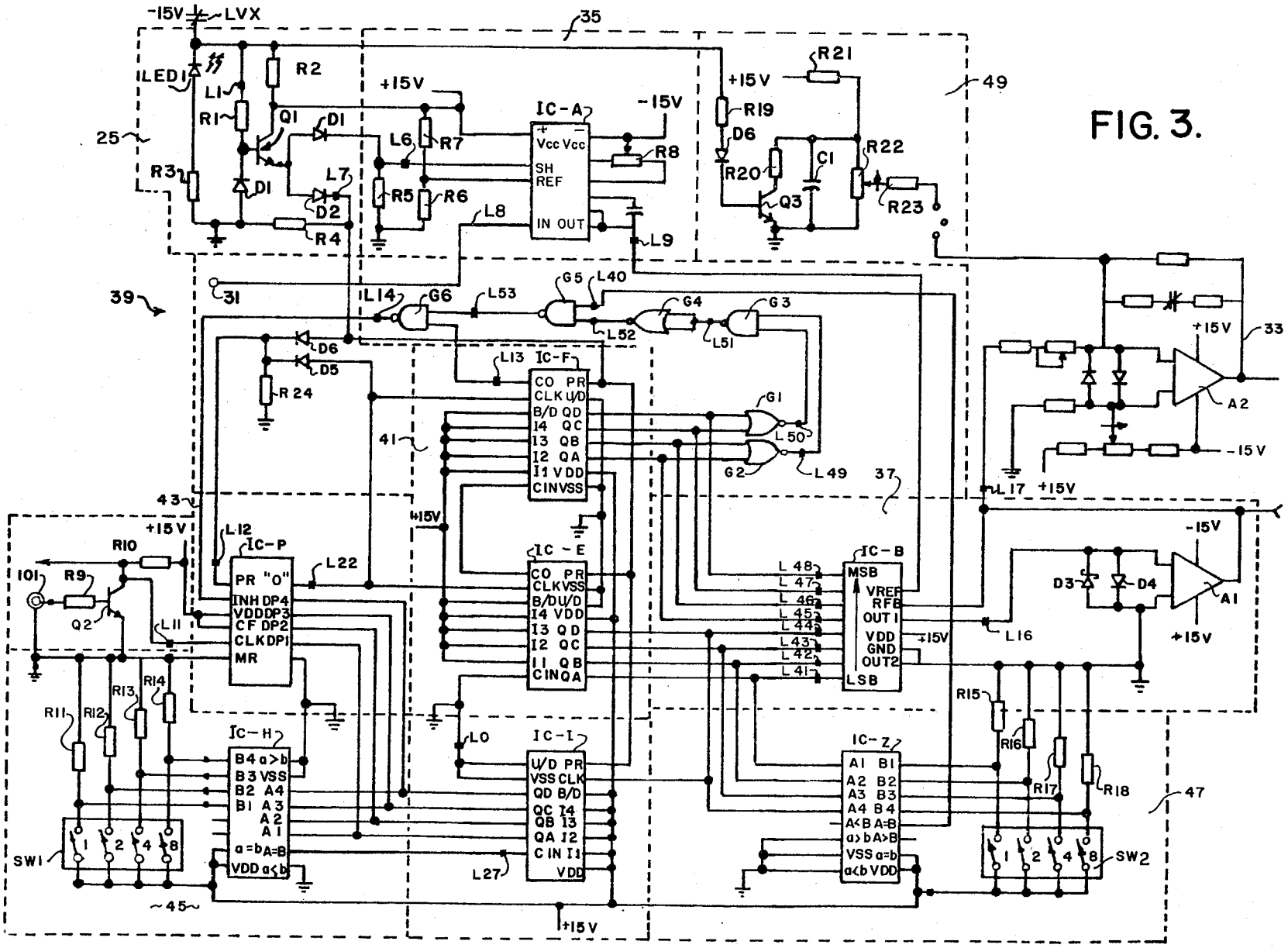
FIG. 3 is a circuit diagram of the landing computer of FIG. 1.

Referring now to FIG. 3 for a detailed disclosure of the circuitry of the landing computer 39 of the present invention, the construction and operation of most of the circuitry will be obvious to those skilled in the art in light of the foregoing description. The details are set forth in the following description.

INTERCEPT SWITCH AND SAMPLE/HOLD SWITCH

The intercept switch 25 and the sample and hold circuit 35 comprise a contact LVX and a sample and hold integrated circuit (chip) IC-A. The contact LVX is controlled by the infra-red sensor pairs 27 and 27', and the chip IC-A is an Analog Devices AD582.

During running mode, the contact LVX remains open, so that the voltage at L1 is positive and the base of transistor Q1 is positively biased by a +15 input, which is applied to the base of transistor Q1 through resistors R1 and R2. The base current is limited by R1. Thus, Q1 is turned on and saturated. The +15 volt signal at the collector of transistor Q1 is loaded to the emitter of transistor Q1. The positive voltage at the emitter of transistor Q1 causes L6 and L7 to be at logic 1. Logic 1 at L6 is applied to the sample/hold switch of sample and hold chip IC-A, thereby maintaining IC-A at sample mode, so that any speed command curve (voltage) from the speed pattern generator 31 is passed through IC-A from the IN pin to the OUT pin. Logic 1 at L7 enables the preset control of all the down counter chips IC-E, IC-F and IC-I as hereinafter described.

During landing mode, contact LVX closes and causes a −15 V input to present at L1. The base of transistor Q1 is negatively biased and the transistor Q1 is turned off. The +15 volt input is blocked by Q1, and both L6 and L7 are pulled down to ground (logic 0) through R6 and R4, respectively. Logic 0 at L6 switches the sample/hold switch of sample and hold chip IC-A to hold mode, at which instant the speed command voltage input at L8 will be held constant as the output at L9 so long as IC-A is at hold mode. Logic 0 at L7 disables the preset control of all the down counters and allows the counters to count down from the preset value.

ENCODER INTERFACE, DIVIDE-BY-N COUNTER AND ITS PRESET CONTROL

The encoder pulse train from digital encoder 21 is applied to the calculator circuit 39 via phone jack 101. Transistor Q2, resistor R9, and resistor R10 raise the amplitude of the pulses at L11 from a 5 V/0 V level to a 15 V/0 V level and also act as a buffer.

The divide-by-N counter 43 includes a National Semiconductor CD4526 programmable divide-by-N chip, IC-P. The pulse train output at L11 is used as a clock signal to count IC-P down from any preset value determined by its divide-by preset inputs DP4, DP3, DP2, and DP1 at the instant when PR (L12) is switched from logic 1 to to logic 0, provided INH (L14) is at logic 0. The "0" output (L22) is normally at logic 0 level; it will go to a logic 1 state only when the counter is at its terminal count (0000). Logic 1 at "0" via diode D5 (L12) presets the counter to the state determined by DP1, DP2, DP3, DP4. Then, "0" goes to its normal logic 0 level, and the counter starts another counting down cycle. The number of pulses needed to generate a single pulse output at "0" is determined by the value set at DP1, DP2, DP3, and DP4.

MAIN DOWN COUNTERS AND AUXILIARY DOWN COUNTER

The down counters 41 include three of National Semiconductor CD4029 presettable binary/decade up/-down counter chips: two main down counter chips IC-E and IC-F, and an auxiliary down counter chip IC-I.

Main counter chips IC-E and IC-F are used as cascaded binary down counters. Preset value inputs (I1, I2, I3, I4) of both counter IC-E and counter IC-F are permanently connected to logic 1 level (+15 V) so that during running (sample) mode when both PR presets (L7) are at logic 1, the output state of the cascaded binary down counters IC-E and IC-F (Q1, Q2, Q3, and Q4 of IC-E and Q1, Q2, Q3, and Q4 of IC-F) remains at its full count state (11111111). The output state of the cascaded binary down counters IC-E and IC-F appears at L41, L42, L43, L44, L45, L46, L47, and L48.

At the transition to landing (hold) mode when L7 goes from logic 1 to logic 0, both presets (PR) are enabled, and the cascaded counters always count down from an initial state of 11111111. Carry in (CIN) of IC-E is tied to ground (logic 0) permanently so that it is ready to count when its preset PR (L7) goes to logic 0. Carry out (CO) of IC-E is normally at logic 1 except when IC-E counts down to 0000. Carry out (CO) of IC-E is tied to CIN of IC-F to provide cascade control. Carry out (CO) of IC-F is normally at logic 1 until IC-F (and also IC-E) counts down to 0000. Logic 0 of IC-F's carry out CO (L13) will change the INH of divide-by-N chip IC-P to logic 1, and thus inhibit the operation of IC-P. Thus, the output state of the cascaded down counters (Q1, Q2, Q3, and Q4 of IC-E and Q1, Q2, Q3, and Q4 of IC-F) stays at 00000000 until the running mode is again entered.

The auxiliary down counter chip IC-I is also used as a binary down counter. The preset control and preset value loading of IC-I to 1111 is the same as for IC-E and IC-F. Its dynamic feedback role in controling the dynamic dividing rate of the divide-by-N chip IC-P is one of the most important merits of the overall circuitry.

The auxiliary down counter chip IC-I is clocked (at its input CLK) by the fourth least significant bit (L44) of the main down counter (i.e., output QD of chip IC-E). Therefore, every sixteen counts, starting from 11111111 (decimal 255) of the main down counter, QD of chip IC-E will send a clock signal to count IC-I down 1 (starting from 1111 or decimal 15). This descending set of states (4-bit data) is fed back to IC-P's divide-by preset inputs DP1–DP4, to decrease the dividing rate, every time IC-I is decreased by 1.

DIGITAL TO ANALOG CONVERTER

The digital-to-analog converter 37 includes an Analog Devices AD7523 8-bit D/A converter chip IC-B.

During running (sample) mode, the control state of IC-B (L41, L42, L43, L44, L45, L46, L47, L48) remains at 11111111 so that the voltage output at L16 is approximately equal to voltage input at L9. The polarity of the speed command curve is reversed by the unity-gain inverter A1, but is otherwise substantially passed through the circuit 39 unchanged.

During landing (hold) mode, input voltage at L9 is held at a constant intercept voltage. The control inputs (L41–L48) of digital-to-analog converter chip IC-B counts down, and the output at L16, is proportional to the count of the control inputs at L41–48, and decreases (decelerates) accordingly.

CURVE SWITCH AND COMPARATOR

The curve switch and comparator include a thumbwheel switch SW1 and a National Semiconductor MM74C85 4-bit magnitude comparator IC-H. Normally, the curve switch SW1 is set between 0110 to 1100 (decimal 6 to 12). IC-H compares two sets of data (A1, A2, A3, A4 and B1, B2, B3, B4). The four A data inputs (A1–A4) of IC-H are connected to the outputs (QA-QD respectively) of auxiliary down counter chip IC-I. The B set of data is determined by the setting of the curve switch SW1. The output (A=B) of the comparator chip IC-H is connected to the carry in (CIN) input of the auxiliary down counter chip IC-I. When A is not equal to B, the output (A=B) of IC-H at L27 is at logic 0, to allow counter IC-I normal count down operation. Whenever the output (QA-QD) of IC-I has counted down to be equal to the value selected by thumb wheel switch SW1, the output A=B of IC-H (L27) goes to logic 1 and inhibits via CIN of IC-I any further count down of IC-I.

FINAL SPEED COMPARATOR, SWITCH AND AUXILIARY GATES

The final speed switch and comparator also include a thumbwheel switch SW2 and a National Semiconductor MM74C85 4-bit magnitude comparator IC-Z, which perform similarly to the curve comparator and switch. The four A data inputs (A1–A4) of IC-Z are connected to the outputs (L41–L44 respectively) of the lower significant bit main down counter IC-E. The B set of data is determined by the setting of the final speed switch SW2. The output (A=B) of the comparator chip IC-Z is connected to one input of a final speed auxiliary NAND gate G5. The four most significant bits (L45–L48 ) of main down counter IC-F are input to final speed auxiliary NOR gates G1 and G2, which are in turn connected to gates G3 and G4 for producing a logical 1 signal at the other input of NAND gates G5 in response to the null (0000) state. Only when all four of the most significant bits of the output of the main down counter have been counted down to 0000, can L45 and L46 as well as L47 and L48 be at logic zero, can the outputs L49 and L50 of NOR gates G1 and G2 respectively both be at logic 1, can the output L51 of NAND gate G3 be at logic 0, and can the output L52 of NOR gate G4 be at logic 1. Under this condition, when a logic 1 is also sent out by IC-Z at the detection of A=B (L40), the output of NAND gate G5 at L53 changes from logic 1 to logic 0 state. This logic 0 state at L53 alone, like logic 0 state at L13 (CO of IC-F), will guarantee of logic 1 state at L14, and thus inhibit the further operation of IC-P. Thus, no more IC-P outputs at L22 are available as clock signals to count the main down counters IC-E and IC-F down any further.

SLOW LANDING SPEED GENERATOR

Because the crawl speed of the elevator is determined by the transfer speed at the moment of transition to landing mode, and because that speed may vary considerably, it is sometimes desirable to provide an auxiliary crawl speed signal generator 49 which is independent of the transfer speed. During running mode, the contact LVX remains open, so that the base of transistor Q3 is positively biased by a +15 input, which is applied to the base of transistor Q3 through resistors R2 and R119 and diode D6. The base current is limited by R19. Thus, Q3 is turned on and saturated. The +15 volt signal at the collector of transistor Q3 is loaded to the emitter of transistor Q3, and the capacitor C1 is discharged. During landing mode, contact LVX closes, the base of transistor Q3 becomes negatively biased, and the transistor Q3 is turned off. The capacitor C1 charges, and a voltage signal is produced across R23, which is adjustable by means of resistor R22. The resistors R21, R22, and R23 and the capacitor C1 are chosen to produce an output which corresponds to a speed of less than five feet per minute. It will be noted that because the landing computer 39 is distance based, depending on the signal from the digital encoder 21 for its distance and speed information, the auxiliary crawl speed signal has no effect on the accuracy with which the system lands the car 5.

OPERATION

Briefly, the operation of the circuit 39 is as follows:

(1) At the instant of transition to landing (hold) mode, every sixteen encoder pulses input at L11 of IC-P generate a single clock output at L22 to count the main down counter IC-E and IC-F down one.

(2) After step 1 occurs sixteen times, IC-I is clocked one time via L44 and counted down one to change the divide-by signal at IC-P's DP1, DP2, DP3, DP4, from 1111 to 1110. At this instant, IC-P starts dividing by fifteen instead of sixteen, since IC-P needs only fifteen encoder pulses to count the main down counters down one.

(3) The cycle repeats by itself. The dividing rate of IC-P of current cycle is always less than that of the preceding cycle by one and higher than that of the subsequent cycle by one.

(4) The cyclic operation described in steps 1–3 will be stopped when CIN (L27) of IC-I goes to logic 1 in response to reaching the value of N set by the curve switch SW1. The dividing rate of IC-P will be maintained as a constant determined by CURVE SWITCH setting.

(5) When IC-P is inhibited (L14) in response to reaching the crawl speed set by final speed switch SW2, or in response to complete countdown of the main counters IC-E and IC-F, the total count down sequence is inhibited and the output at L17 is locked in at the final corresponding speed. If the auxiliary crawl speed signal generator 49 is utilized, the final crawl speed will also reflect its output.

(6) When the leveling transducers 27 and 27' straddle the vane 23, the transducers 68 puts out a signal, not shown, to set the brakes of the car 5 and to bring the signal applied to the motor 29 to zero.

Numerous variations in the landing system of the present invention, within the scope of the appended claims, will occur to those skilled in the art in light of the foregoing disclosure. For example, the landing computer of the invention may be differently configured, although the preferred configuration has certain advantages over alternatives. The speed pattern generator may be distance based, rather than time based. Other digital encoders or other distance measurement devices may be utilized for the landing portion of the car 5's travel or for its entire travel. Other landing transducers may be utilized. These variations are merely illustrative.

We claim:

1. In a transportation system for moving an object along a fixed path and stopping said object at landing points on said fixed path, said system including motive means for moving said object, pattern generating means for generating a running speed signal to control the operation of said motive means, and transfer means for establishing a transfer position of said object a fixed distance from a pre-selected landing point, the improvement comprising digital landing computer means for controlling movement of said object between said transfer position and said landing point, said digital landing computer means comprising first means for holding a transfer speed value, said transfer speed value being a function of the instantaneous value of said running speed signal generated by said pattern generating means at the time when said object reaches said transfer position;

second means for generating digital signals indicative of the position of said object with respect to said path at least between said transfer position and said landing point;

third means responsive to said digital signals for sequentially calculating a plurality of deceleration signals; and fourth means responsive to said deceleration signals and to said transfer speed value for generating a landing speed signal to control the operation of said motive means, for smoothly and incrementally changing the rate of deceleration of said object from said transfer speed value to a final speed value.

2. The improvement of claim 1 wherein said pattern generating means include means for generating an acceleration and deceleration pattern for accelerating and decelerating said object.

3. The improvement of claim 2 wherein said running speed signal and said landing speed signal are analog values, and wherein said fourth means comprise a digital-to-analog converter.

4. The improvement of claim 3 wherein said second means comprise means operatively connected to said object for generating a train of pulses, each pulse representing movement of said object through a particular distance along said path.

5. The improvement of claim 4 wherein said third means comprise means for smoothly and incrementally changing the rate of deceleration of said object from said transfer speed value to a final crawl speed.

6. The improvement of claim 5 wherein said third means comprise a down counter operatively connected to said digital-to-analog converter for decrementing the digital input to said digital-to-analog converter, and means operatively connected between said second means and said down counter for sequentially reducing the number of said pulses required to decrement said digital input to said digital-to-analog converter.

7. The improvement of claim 6 wherein said means operatively connected between said second means and said down counter comprises divide-by-N means, a control input of said divide-by-N means being operatively connected to the output of said down counter for reducing the value of N in response to an output signal from said down counter.

8. The improvement of claim 7 further comprising curve switch means connected to said divide-by-N means, said curve switch means setting a minimum value of N, thereby fixing the total number of said pulses required to decrement the digital input to said digital-to-analog converter to a pre-selected number.

9. The improvement of claim 7 further comprising final speed switch means for setting a minimum value of said digital input to said digital-to-analog converter.

10. The improvement of claim 1 further including means for generating a crawl speed signal, said crawl speed signal being applied to said motive means independent of said landing speed signal during the last fraction of an inch of travel of said object before said landing.

11. In a transportation system for moving an object along a fixed path and stopping said object at landing points on said fixed path, said system including motive means for moving said object, pattern generating means for generating a running speed signal to control the operation of said motive means in a run mode of said transportation system, said pattern generating means including means for accelerating said object from a first landing point and decelerating said object as said object approaches a second landing point, and transfer means for establishing a transfer position of said object a fixed distance from said second landing point, the improvement comprising landing computer means for controlling movement of said object in a landing mode between said transfer position and said second landing point, said landing computer means comprising means for determining a transfer speed value indicative of the instantaneous value of said running speed signal generated by said pattern generating means at the time when said object reaches said transfer position; and landing signal generating means responsive to said transfer speed value and operating on said transfer speed value to generate a landing speed signal to control the operation of said motive means, for smoothly and incrementally changing the rate of deceleration of said object from said transfer speed value to a final speed value.

12. The improvement of claim 11 wherein said landing signal generating means comprise a digital-to-analog converter interposed between said pattern generating means and said motive means, means for maintaining the digital input to said digital-to-analog converter at a constant value while said transportation system is in said run mode, and means for changing the digital input to said digital-to-analog converter in said landing mode to provide a smooth transition from said run mode to said landing mode, across a substantial range of values of said transfer value.

13. The improvement of claim 12 wherein said means for determining a transfer speed value comprise means arranged between said pattern generating means and said digital-to-analog converter, said means responding to said transfer means to hold the instantaneous value of said running speed signal.

14. The improvement of claim 12 wherein said landing signal generator means further comprise a digital signal generator for generating signals indicative of the position of said object with respect to said path between said transfer position and said landing point, said digital signal generator being operatively connected to said digital-to-analog converter for changing the digital input to said digital-to-analog converter.

15. The improvement of claim 14 wherein said digital signal generator is connected to said digital-to-analog converter through a down counter, for reducing the value of said digital input to said digital-to-analog converter.

16. The improvement of claim 14 further including a divide-by-N circuit connected between said digital signal generator and said down counter, said divide-by-N circuit reducing the number of digital signals required to count down said down counter as said object approaches said second landing point.

17. The improvement of claim 11 wherein said transfer means comprise a marker fixedly mounted with respect to said path.

18. In an elevator system for moving an elevator car along a fixed path and stopping said car at landing points on said fixed path, said system including motive means for moving said car, pattern generating means for generating a running speed signal to control the operation of said motive means, and transfer means for establishing a transfer position of said car a fixed distance from a pre-selected landing point, the improvement comprising landing computer means for controlling movement of said car between said transfer position and said landing point, said landing computer means comprising converter means operatively connected to said motive means, said converter means responding to a control signal to vary the relationship between an input signal and an output signal applied to said motive means;

sample and hold means for applying said running speed signal from said pattern generating means as an input to said converter means during a run mode of said elevator system and responsive to said transfer means when said elevator car reaches said transfer position for applying a transfer speed signal as an input to said converter means during a landing mode of said elevator system, said transfer speed signal being the instantaneous running speed signal at said transfer position; and control means for maintaining the control signal input to said converter means at a constant value while said elevator system is in said run mode, and responsive to said transfer means for gradually changing the control signal input to said converter means in said landing mode to provide a smooth transition from said run mode to said landing mode, across a substantial range of values of said transfer speed value.

19. The improvement of claim 18 wherein said control means comprise position indicating means for generating position signals indicative of the position of said car with respect to said path at least between said transfer position and said landing point, and calculation means responsive to said position signals for sequentially calculating a plurality of deceleration signals and applying said deceleration signals to said converter means.

20. The improvement of claim 19 wherein said landing signal generator means comprise a digital-to-analog converter interposed between said pattern generating means and said motive means, and wherein said position indicating means comprise means operatively connected to said car for generating a train of pulses, each pulse representing movement of said car through a particular distance along said path.

21. The improvement of claim 20 wherein said calculation means comprise means for smoothly and incrementally changing the rate of deceleration of said car from said transfer speed value to a final crawl speed, said calculation means reducing said speed more slowly per unit traveled as said car approaches said landing.

22. In a method of controlling the movement and landing of an elevator car operated by a motive system, said method comprising applying a variable speed running signal to said motive system in accordance with a pre-established running signal program, said running signal program including a deceleration program for decelerating said car as it approaches a landing floor, sensing the arrival of said car at a position a fixed distance from a landing floor, and thereafter controlling the landing of said car at the landing floor, the improvement comprising controlling substantially the entire landing of said car as a function of the instantaneous value of said running signal applied in accordance with said pre-established running signal program when said car arrives at said position a fixed distance from said landing floor.

* * * * *

UNITED STATES PATENT AND TRADEMARK OFFICE

CERTIFICATE OF CORRECTION

PATENT NO. : 4,570,755

DATED : February 18, 1986

INVENTOR(S) : George C. Tsai et al

It is certified that error appears in the above-identified patent and that said Letters Patent is hereby corrected as shown below:

Page one,"[73] Assignee: Armor Electric Company"
should be ---Armor Elevator Company---

Signed and Sealed this

*Twenty-second* Day of *July 1986*

[SEAL]

*Attest:*

DONALD J. QUIGG

*Attesting Officer*

*Commissioner of Patents and Trademarks*